US011832733B2

(12) United States Patent
Salter

(10) Patent No.: US 11,832,733 B2
(45) Date of Patent: Dec. 5, 2023

(54) ORTHOPEDIC DEVICE AND METHOD

(71) Applicant: Linda Salter, Ingleside (CA)

(72) Inventor: Linda Salter, Ingleside (CA)

( * ) Notice: Subject to any disclaimer, the term of this patent is extended or adjusted under 35 U.S.C. 154(b) by 0 days.

(21) Appl. No.: 17/150,951

(22) Filed: Jan. 15, 2021

(65) Prior Publication Data

US 2022/0225775 A1 Jul. 21, 2022

(51) Int. Cl.
*A47C 7/02* (2006.01)

(52) U.S. Cl.
CPC ..... *A47C 7/029* (2018.08); *A47C 7/0213* (2018.08)

(58) Field of Classification Search
CPC ..... A47C 7/021; A47C 7/0213; A47C 7/024; A47C 7/029
See application file for complete search history.

(56) References Cited

U.S. PATENT DOCUMENTS 679,915 A * 8/1901 Rudolf ..... A47C 7/029 5/653
2,765,480 A * 10/1956 Mueller ..... A61G 7/05738 5/640
2,825,393 A * 3/1958 Warburton ..... A47C 7/16 267/103
3,276,047 A * 10/1966 Emery ..... A47C 7/021 5/654
4,646,374 A * 3/1987 Shafer ..... A47C 27/148 5/653
4,824,169 A * 4/1989 Jarrell ..... A47C 7/425 297/284.1
4,824,174 A * 4/1989 Dunn, Sr. ..... A47C 7/024 297/452.46
5,286,089 A * 2/1994 Goldman ..... A47C 7/024 297/452.26
5,442,823 A * 8/1995 Siekman ..... A47C 7/029 5/653
5,611,098 A * 3/1997 Skibik ..... A42B 1/006 108/43
6,018,831 A * 2/2000 Loomos ..... A47G 9/10 5/490
7,024,714 B1 * 4/2006 Yates ..... A47C 27/085 5/654

(Continued)

FOREIGN PATENT DOCUMENTS

GB 2520264 A * 5/2015 ..... A47C 7/142
JP 2002238690 A * 8/2002 ..... A47C 7/024

(Continued)

*Primary Examiner* — Rodney B White
(74) *Attorney, Agent, or Firm* — CAPEHART LAW FIRM

(57) ABSTRACT

An orthopedic device; the orthopedic device includes a cushion having a left side and a right side having different heights to level and correct a lateral pelvic tilt in a seated user. In one embodiment, the left side and the right side may each include pads for supporting respective buttocks of the seated user seated with lateral pelvic tilt. In another embodiment, the cushion may be used for supporting just one buttock of the seated user seated with lateral pelvic tilt. A method for diagnosing lateral pelvic tilt and for using the orthopedic device to correct the lateral pelvic tilt is also disclosed herein. The orthopedic device is useful for relieving, or at least substantially relieving, back pain and pressure associated with lateral pelvic tilt.

6 Claims, 6 Drawing Sheets

(56) References Cited

U.S. PATENT DOCUMENTS

| | | | | |
|---|---|---|---|---|
| 8,566,987 | B1 * | 10/2013 | Burge | A47C 27/15 5/655.9 |
| 8,696,059 | B2 * | 4/2014 | Carmichael, IV | A47C 7/02 297/202 |
| 8,850,645 | B1 * | 10/2014 | Jackson | A47C 4/52 5/654 |
| 9,609,951 | B2 * | 4/2017 | Chan | A47C 7/35 |
| 10,092,110 | B1 * | 10/2018 | Mohammadi | A47C 27/14 |
| 10,646,049 | B2 * | 5/2020 | Sprouse, II | A47C 7/021 |
| 2001/0040402 | A1 * | 11/2001 | Odderson | A61G 5/1043 297/452.21 |
| 2008/0216245 | A1 * | 9/2008 | Liners | A47C 7/021 5/654 |
| 2014/0054948 | A1 * | 2/2014 | Bachar | A47C 7/021 297/452.48 |
| 2014/0259426 | A1 * | 9/2014 | Pearce | A47C 7/021 5/653 |
| 2019/0038031 | A1 * | 2/2019 | Breibart | A47C 7/18 |
| 2019/0125094 | A1 * | 5/2019 | Sprouse, II | A47C 27/081 |

FOREIGN PATENT DOCUMENTS

| | | | | | |
|---|---|---|---|---|---|
| KR | 20080000706 | U | * | 4/2008 | |
| WO | WO-2017064480 | A1 | * | 4/2017 | A47C 1/022 |
| WO | WO-2020214978 | A1 | * | 10/2020 | A47C 7/18 |

* cited by examiner

ORTHOPEDIC DEVICE AND METHOD

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of orthopedic devices of existing art and more specifically relates to an orthopedic cushion for correcting lateral pelvic tilt.

RELATED ART

Muscle imbalance is a leading cause of movement dysfunction in individuals, with 30% of cases being due to structural issues such as scoliosis. Lateral pelvic tilt is a type of muscle imbalance which includes the pelvis being tilted laterally in relation to the body. The pelvis plays a hugely important role in allowing individuals to walk and maintain good posture. As such, when not aligned properly, it causes many issues for the individual, such as chronic reoccurring back pain.

Lateral pelvic tilt is a form of pelvic tilt in the sagittal plane, which involves one hip being higher than the other. Today's normal assessment of this dysfunction by professionals is in standing position, which can mislead results for seated problems. There is currently little to no research or information on assessment for individuals in seated static position. Most individuals are not laterally tilted when assessed standing but are laterally tilted when seated. In today's world most people have sitting jobs or are seated most of the day. This is a problem as the lateral pelvic tilt may be exacerbated when the individual is seated, as they may tend to put more weight on the lower side.

Attempts have been made to correct lateral pelvic tilt, such as through exercise and stretches. However, these attempts are not satisfactory as many individuals do not have time perform exercises daily, and many times even if they do perform the exercises the pain returns. Further, in many individuals, current assessment methods for lateral pelvic tilt are not satisfactory. Due to this, many individuals are left with no cure for their recurrent back pain. Thus, a suitable solution is desired.

SUMMARY OF THE INVENTION

In view of the foregoing disadvantages inherent in the known orthopedic device art, the present disclosure provides a novel orthopedic device and method. The general purpose of the present disclosure, which will be described subsequently in greater detail, is to provide an orthopedic device designed to be used by a seated user to correct lateral pelvic tilt, and a method for diagnosing lateral pelvic tilt in the seated user.

An orthopedic device is disclosed herein. The orthopedic device includes a cushion including a left cushion-side and a right cushion-side relative to a seated user. The left cushion-side may include a first thickness defining a first height and the right cushion-side may include a second thickness defining a second height. The first height and the second height may be different and may define a height differential between the left cushion-side and the cushion-right side.

Using the present orthopedic device, the height differential may be customized to the seated user. The height differential may be determined by: evaluating a lateral pelvic tilt between a left side and a right side of the seated user; determining a deviation height of the lateral pelvic tilt; and providing the left cushion-side and the right cushion-side including the height differential based on the deviation height of the evaluated lateral pelvic tilt.

According to another embodiment, a method for correcting lateral pelvic tilt using an orthopedic device is also disclosed herein. The method includes: evaluating the lateral pelvic tilt between a left side and a right side of the seated user; determining a deviation height of the lateral pelvic tilt, wherein a determination stage includes: providing the orthopedic device based on an evaluation stage and a determination stage.

The evaluation stage may include: the seated user sitting in front of an examiner with their back to the examiner; the examiner observing the back of the seated user for lateral deviation between the left side and right side of the seated user; the examiner feeling the back of the seated user for correct pelvic placement; the examiner reobserving the back of the seated user; and the examiner indicating which side of the seated user is to be lifted. The determination stage may include: the seated user standing; the examiner placing a test-pad under an ischial tuberosity of a hip of the seated user on a side indicated to be lifted in the evaluation; and the seated user sitting on the test-pad, wherein at least substantial relief of discomfort upon sitting on the test-pad renders the determination step complete, and wherein no substantial relief of discomfort indicates a necessity for repeating the determination stage until discomfort is at least substantially relieved.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, an orthopedic device and method, constructed and operative according to the teachings of the present disclosure.

The various embodiments of the present invention will hereinafter be described in conjunction with the appended drawings, wherein like designations denote like elements.

DETAILED DESCRIPTION

Figure 1:
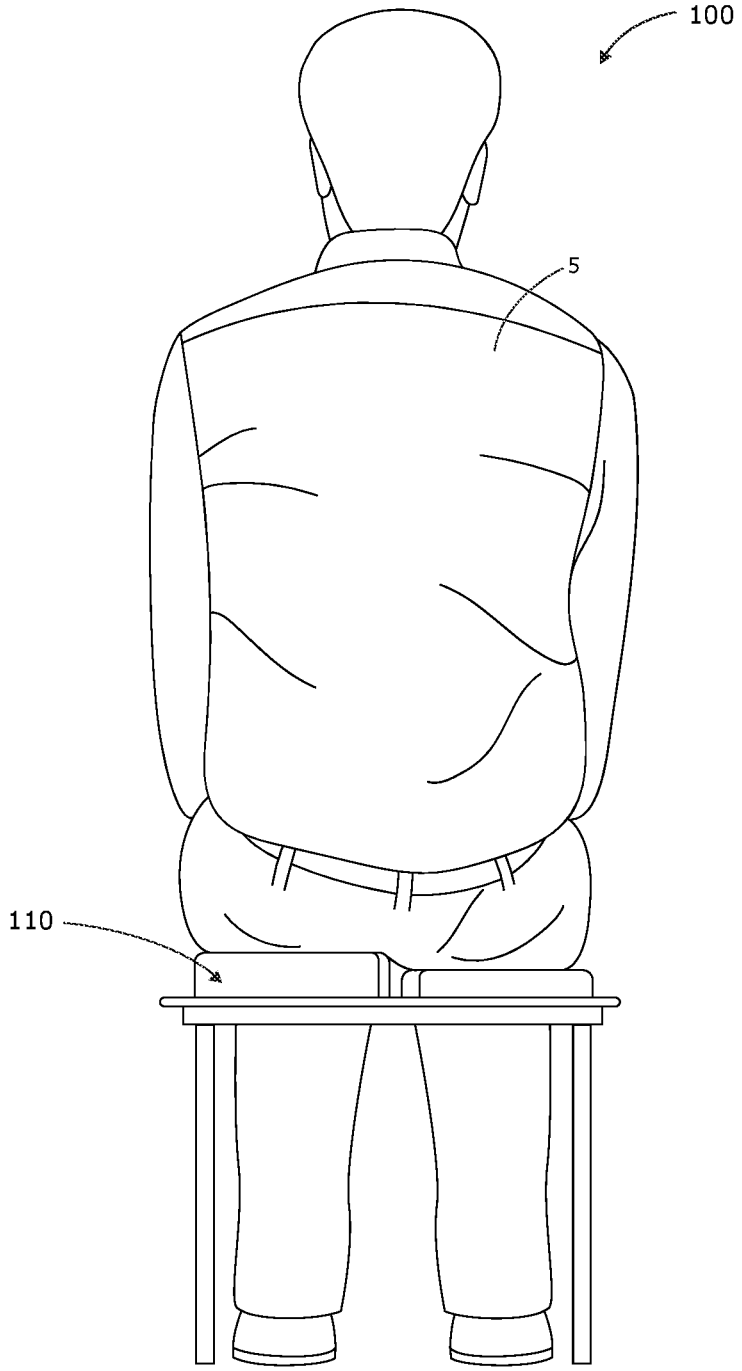
FIG. 1 is a rear perspective view of the orthopedic device during an 'in-use' condition, showing a user sitting on the orthopedic device with their hips and knees bent at a 90-degree angle and their feet flat on the floor anterior to their body, according to an embodiment of the disclosure.
Figure 2:
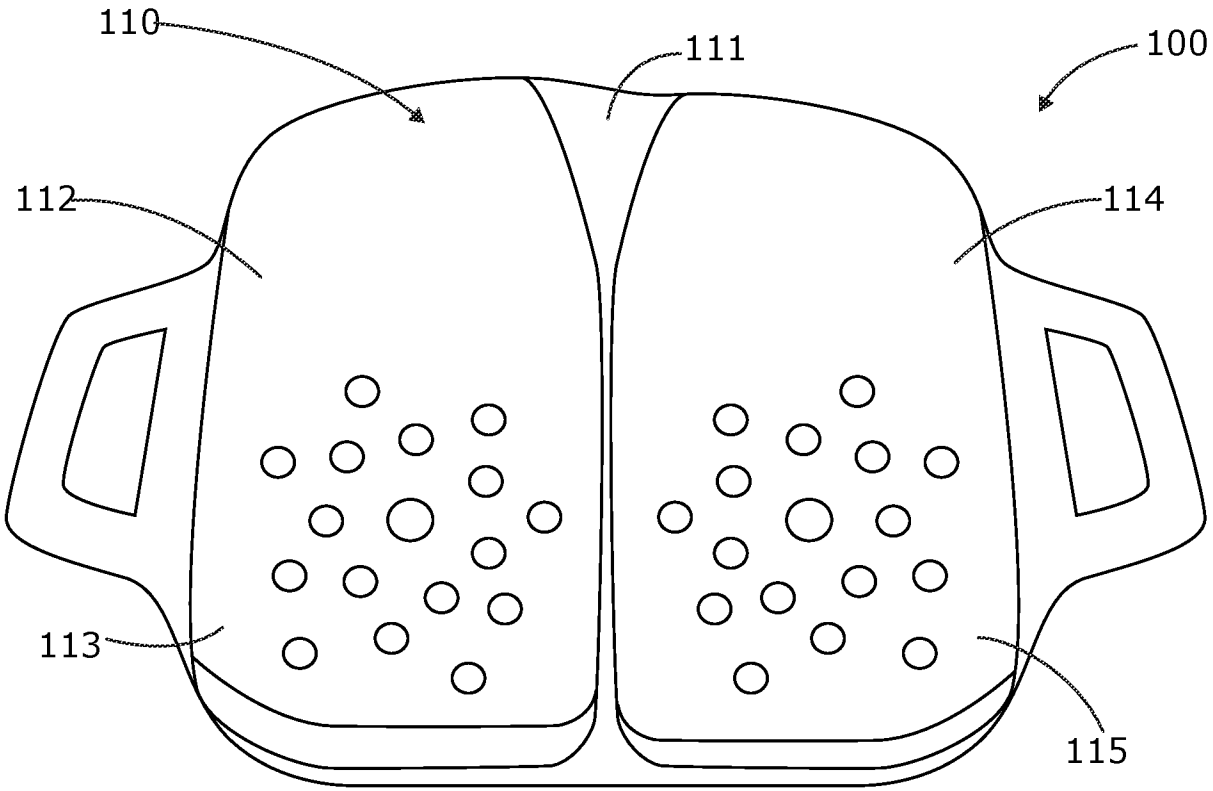
FIG. 2 is a top front perspective view of the orthopedic device of FIG. 1, according to an embodiment of the present disclosure.
Figure 3:
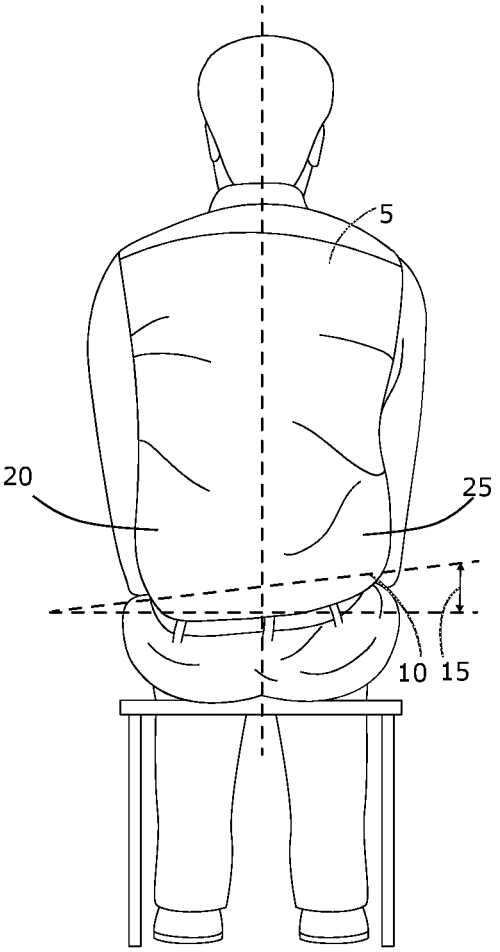
FIG. 3 is a rear perspective view of a seated user having a lateral pelvic tilt, according to an embodiment of the present disclosure.
Figure 4:
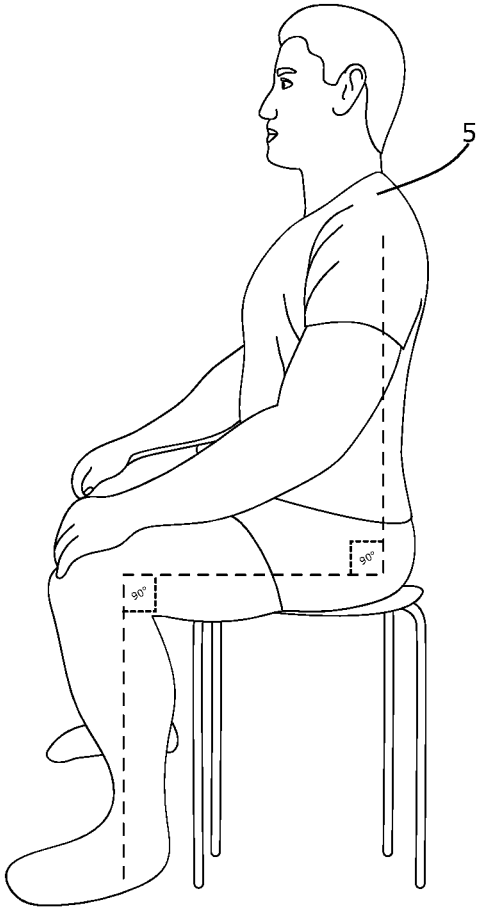
FIG. 4 is a side perspective view of the seated user sat with their hips and knees bent at the 90-degree angle and their feet flat on the floor anterior to their body, according to an embodiment of the present disclosure.
Figure 5:
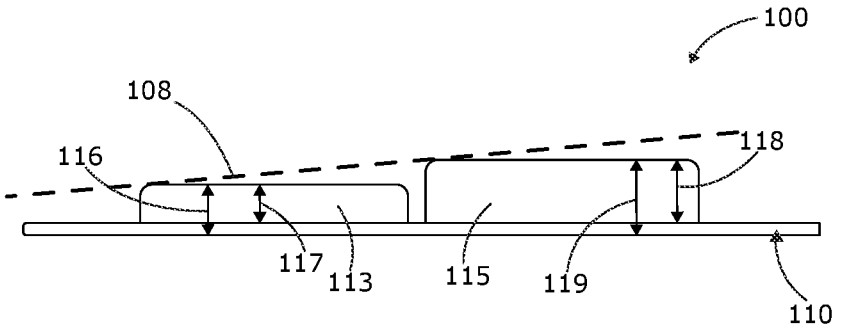
FIG. 5 is a side perspective view of the orthopedic device of FIG. 1, illustrating a left pad and a right pad including different heights, according to an embodiment of the present disclosure.

As discussed above, embodiments of the present disclosure relate to an orthopedic device and more particularly to an orthopedic device and method as used to improve a lateral pelvic tilt of a seated user. The orthopedic device may help individuals with lower back pain, hip pain, arthritis, cervical radiculopathy, muscular or structural deformities, imbalance, asymmetry, sciatica, pregnancy, sacroiliac joint pain, osteoporosis, scoliosis, degenerative disc disease, spinal stenosis, herniated disc, coccyx pain, migraines and may prevent most of these dysfunctions in younger individuals from happening in the future. Preferably, the orthopedic device may be portable and used in any setting where the individual will be sitting.

Generally disclosed is a cushion including a left side and a right side having different heights to correct and level lateral pelvic tilt when sitting. Height difference may depend on how deviated the lateral pelvic tilt is. For example, the left side may include a 2-inch thickness and the right side may include a 3-inch thickness to correct a deviation of 1 inch. The cushion, or at least a portion of the cushion, may include a gel material. In combination with the gel material, or instead of gel material, the cushion (or at least a portion thereof) may include a foam material. One embodiment of the cushion may include a left pad and a right pad for supporting both buttocks of the seated user. Another embodiment of the cushion may include a single slightly concave piece that is easily carried and specially shaped to fit under just one buttock (or one ischial tuberosity).

A method, or orthopedic test, may be used in diagnosing lateral pelvic tilt, and/or correcting lateral pelvic tilt using the orthopedic device. The method may include: a patient sitting in front of an examiner with their back to the examiner with their hips and knees flexed at 90 degrees; the examiner looking for lateral deviation between a left side and a right side of a posterior superior iliac spine of the patient; the examiner placing their index fingers in either dimple of the left and right posterior superior iliac spine and slightly moving the index finger around to feel correct placement; the examiner reobserving pelvic tilt levels and indicating which side needs to be lifted; the patient standing while the examiner places a pad on a seat under an ischial tuberosity of the patient; and the patient sitting on the pad. If discomfort, such as pain or pressure is eliminated, or at least substantially eased for the patient, the test is positive. The examiner may use pads with different thicknesses in different cases, depending on deviation of the lateral pelvic tilt.

It is contemplated that the cushion and the orthopedic test may become a standard test and tool in basic assessment for all therapists and doctors in evaluation, assessment and diagnosis of most musculoskeletal dysfunctions.

Referring now more specifically to the drawings by numerals of reference, there is shown in FIGS. 1-7, various views of an orthopedic device 100.

FIG. 1 shows an orthopedic device 100 during an 'in-use' condition, according to an embodiment of the present disclosure. Here, the orthopedic device 100 may be beneficial for use by a user to correct and level a lateral pelvic tilt. As illustrated, the orthopedic device 100 may include a cushion 110. As shown, the cushion 110 may include different heights at each side such that when the seated user 5 is sat on the cushion 110, it corrects their lateral pelvic tilt 10 (FIG. 3) and prevents, or at least substantially prevents, discomfort associated therewith. In some embodiments, the cushion 110 may be incorporated into chairs, such as office chairs, wheelchairs, etc. and car seats.

Referring now to FIGS. 3-7 showing various views of the orthopedic device 100 of FIG. 1, according to an embodiment of the present disclosure. As shown, the cushion 110 may include a left cushion-side 112 and a right cushion-side 114 relative to the seated user 5. The left cushion-side 112 may include a left pad 113 configured to support a left buttock of the seated user 5 and the right cushion-side 114 may include a right pad 115 configured to support a right buttock of the seated user 5. In this embodiment, the left pad 113 may include a first thickness 116 defining a first height 117 and the right pad 115 may include a second thickness 118 defining a second height 119. The first height 117 and the second height 119 may be different and define a height differential 108 between the left pad 113 and the right pad 115. Preferably, the cushion 110 may be reversible such that the left cushion-side 112 becomes the right cushion-side 114 and vice versa (and thereby the height differential 108 may be reversed). This may allow the seated user 5 to use either side or may allow the orthopedic device 100 to be used by more than one seated user 5.

Further, as shown, the cushion 110 may include a relief gap 111 configured for coccyx pressure relief for the seated user 5. The relief gap 111 may be located between the left pad 113 and the right pad 115. The left pad 113 and the right pad 115 may include a gel material. For example, the gel material may include a rubber gel, a silicone gel, a plastic gel, or the like. In some embodiments, the left pad 113 and the right pad 115 may further include a foam material. The foam material may be included in addition to the gel material. The foam material may be soft or firm. For example, the foam material may be memory foam. In addition, as shown, the cushion 110 may further include a left handle 121 and a right handle 123 located at the left cushion-side 112 and the right cushion-side 114, respectively. The left handle 121 and the right handle 123 may aid in portability of the orthopedic device 100.

The height differential 108 may be customized to the seated user 5. The height differential 108 may be determined by evaluating a lateral pelvic tilt 10 between a left side 20 and a right side 25 of the seated user 5; determining a deviation height 15 of the lateral pelvic tilt 10; and providing the left pad 113 and the right pad 115 including the different heights based on the deviation height 15 of the evaluated lateral pelvic tilt 10. In some embodiments, the height differential 108 between the first height 117 and the second height 119 may be equal to, or at least substantially equal to, the deviation height 15. For example, if the seated user 5 has a lateral pelvic tilt 10 that includes their right hip being higher than their left hip by one inch, they may be provided with the orthopedic device 100 including the left pad 113 being one inch higher than the right pad 115, so that the cushion 110 evens out the lateral pelvic tilt 10 when the seated user 5 is sitting on the orthopedic device 100. The left side 20 and the right side 25 of the seated user 5 may be relative to a posterior superior iliac spine of the seated user 5.

In other embodiments, the height differential 108 may not be equal to the deviation height 15. For example, the right hip of the seated user 5 may be one inch higher than the left hip of the seated user 5, but they may require a cushion 110 having a height differential of 0.5 inches between the left pad 113 and the right pad 115. In any embodiment, it should be appreciated that the height differential 108 may be correct when the seated user 5 is relieved of, or at least substantially relieved of, discomfort such as pain and/or pressure associated with the lateral pelvic tilt 10.

Figure 6:
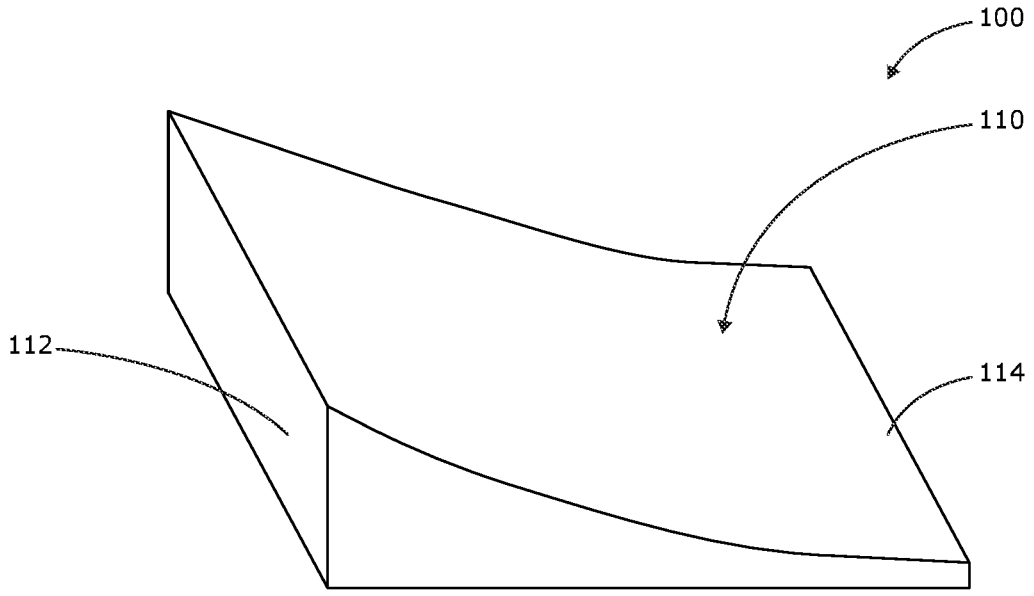
FIG. 6 is a top perspective view of the orthopedic device according to another embodiment of the present disclosure.
Figure 7:
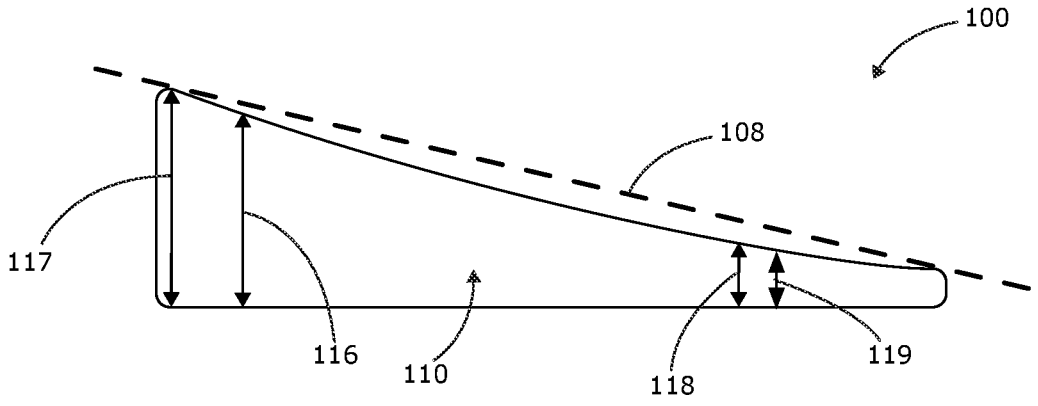
FIG. 7 is a side perspective view of the orthopedic device of FIG. 5, according to another embodiment of the present disclosure.

Referring now to FIGS. 6 and 7 showing various views of the orthopedic device 100 according to another embodiment of the present disclosure. As shown, in some embodiments, the cushion 110 may be configured to support only one of a left buttock and alternately a right buttock of the seated user 5. This may be a smaller, more compact size allowing for greater portability. In this version of the orthopedic device 100 the left cushion-side 112 may include the first thickness 116 defining the first height 117 and the right cushion-side 114 may include the second thickness 118 defining the second height 119 (as opposed to the left pad 113 and the right pad 115 providing the heights [117, 119]).

In this embodiment, one of the left cushion-side 112 and the right cushion-side 114 may be tapered to form the height differential 108 between the left cushion-side 112 and the right cushion-side 114. The seated user 5 may place a non-tapered side (a higher side) under the side needed to be raised. For example, if the seated user 5 has a lateral pelvic tilt 10 that includes their right hip being higher than their left hip by one inch, they may place the cushion 110 under their left buttock, with the right cushion-side 114 being tapered such that the left cushion-side 112 is higher than the right cushion-side 114, thereby correcting the lateral pelvic tilt 10 for the seated user 5.

In some embodiments, as discussed above, the height differential 108 may be customized to the seated user 5. The height differential 108 may be determined by evaluating a lateral pelvic tilt 10 between a left side 20 and a right side 25 of the seated user 5; determining a deviation height 15 of the lateral pelvic tilt 10; and providing the left cushion-side 112 and the right cushion-side 114 including the height differential 108 based on the deviation height 15 of the evaluated lateral pelvic tilt 10. Further, as above, the cushion 110 may preferably be reversible such that the left cushion-side 112 becomes the right cushion-side 114 and vice versa. This may allow the seated user 5 to use the cushion 110 on either side or may allow the cushion 110 to be used by more than one seated user 5. The cushion 110 may also include an at least partially concave shape and may be made from the foam material as discussed above.

In some embodiments, the orthopedic device 100 may be made custom for the seated user 5 based on evaluation of the lateral pelvic tilt 10. In other embodiments, the orthopedic device 100 may include a standard height differential 108. For example, one orthopedic device 100 may include a height differential 108 of one inch, and another orthopedic device 100 may include a height differential 108 of two inches. The seated user 5 may utilize the orthopedic device 100 with the height differential 108 that is equal to or at least substantially equal to, a deviation height 15 of their lateral pelvic tilt 10, or simply, the height differential 108 that relieves, or at least substantially relieves, discomfort such as pain and/or pressure associated with their lateral pelvic tilt 10.

Figure 8:
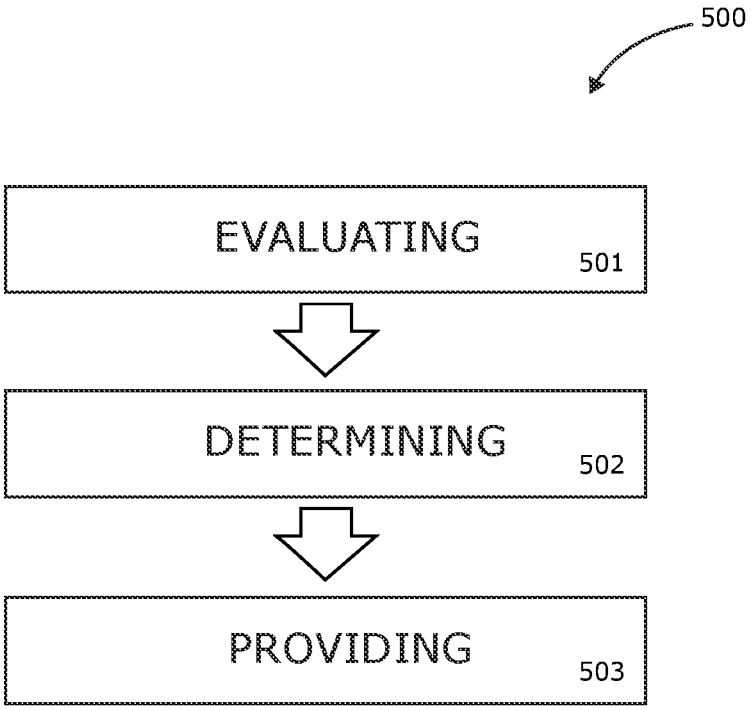
FIG. 8 is a flow diagram illustrating a method for correcting lateral pelvic tilt using an orthopedic device, according to an embodiment of the present disclosure.

Referring now to FIG. 8 showing a flow diagram illustrating a method 500 for correcting lateral pelvic tilt using an orthopedic device, according to an embodiment of the present disclosure. In particular, the method 500 may include one or more components or features of the orthopedic device 100 as described above. As illustrated, the method of use 500 may include the steps of: step one 501, evaluating the lateral pelvic tilt 10 between a left side 20 and a right side 25 of the seated user 5; step two 502, determining a deviation height 15 of the lateral pelvic tilt 10; and step three 503, providing the orthopedic device 100 based on an evaluation stage and a determination stage.

Figure 9:
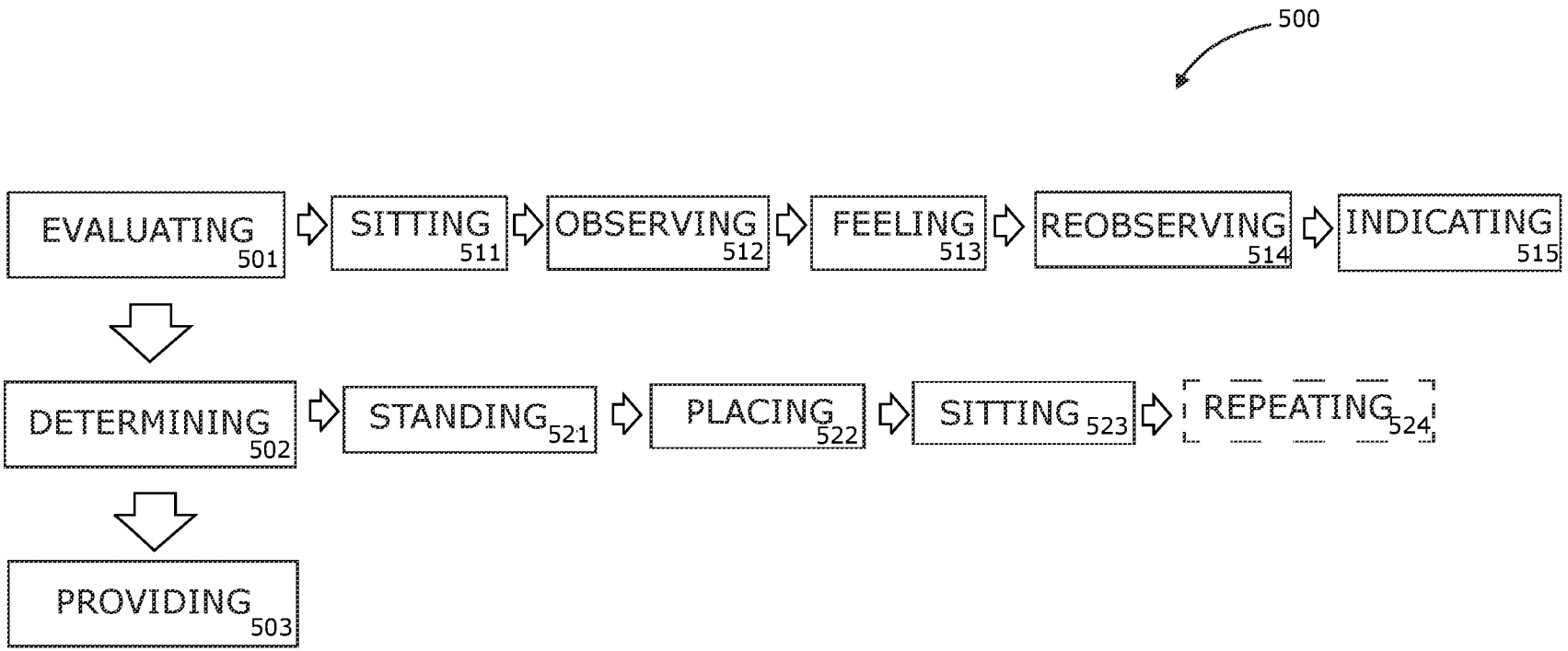
FIG. 9 is a flow diagram illustrating the method for correcting lateral pelvic tilt using an orthopedic device and further expanding on each step, according to an embodiment of the present disclosure.

As shown in FIG. 9, the evaluation stage may include: the seated user 5 sitting 511 in front of an examiner with their back to the examiner; the examiner observing 512 the back of the seated user 5 for lateral deviation between the left side 20 and right side 25 of the seated user 5; the examiner feeling 513 a back of the seated user 5 for correct pelvic placement; the examiner reobserving 514 the back of the seated user 5; and the examiner indicating 515 which side of the seated user 5 is to be lifted. Preferably, the evaluation stage may include the seated user 5 sitting in front of the examiner with their back to the examiner and with their knees and hips flexed at 90 degrees. As above, the left side 20 and the right side 25 of the seated user 5 may be relative to a posterior superior iliac spine of the seated user 5. It may be important to have the seated user 5 sitting in front of the examiner (rather than standing) as the lateral pelvic tilt 10 and/or a correct deviation height 15 of the lateral pelvic tilt 10 may not be immediately recognizable in a standing user.

Further, the determination stage may include: the seated user 5 standing 521; the examiner placing 522 a test-pad under an ischial tuberosity of a hip of the seated user 5 on a side indicated to be lifted in the evaluation; and the seated user 5 sitting 523 on the test-pad, wherein relief of discomfort upon sitting (or at least substantial relief of discomfort) on the test-pad renders the determination step complete, and wherein no substantial relief of discomfort indicates a necessity for repeating 524 the determination stage until discomfort (pain and/or pressure) is at least substantially relieved.

The orthopedic device 100 provided may be the embodiment configured to support only one of a left buttock and a right buttock of the seated user 5, or the embodiment including the left pad 113 configured to support the left buttock of the seated user 5 and the right pad 115 configured to support the right buttock of the seated user 5. In any embodiment, as discussed above, the side indicated to be lifted in the evaluation stage should include a greater height (than an opposite side). It should be appreciated that the discomfort may be on either side of the seated user 5, regardless of which side needs to be lifted.

It should also be appreciated that the method 500 is also contemplated for use without providing the orthopedic device 100. For example, the method 500 may be used to diagnose lateral pelvic tilt 10 in a patient, and the examiner may then recommend other aids such as exercise, stretches, and the like. The examiner may utilize the method 500 to establish a treatment plan, which may or may not include providing 503 the orthopedic device 100.

It should be noted that step 524 is an optional step and may not be implemented in all cases. Optional steps of the method 500 are illustrated using dotted lines in FIG. 8 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for diagnosing lateral pelvic tilt and correcting the lateral pelvic tilt using the orthopedic device are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A method for correcting lateral pelvic tilt using an orthopedic device, the method comprising:

evaluating the lateral pelvic tilt between a left side and a right side of the seated user, wherein an evaluation stage includes:

the seated user sitting in front of an examiner with their back to the examiner;

the examiner observing the back of the seated user for lateral deviation between the left side and right side of the seated user;

the examiner feeling the back of the seated user for correct pelvic placement;

the examiner reobserving the back of the seated user; and the examiner indicating which side of the seated user is to be lifted;

determining a deviation height of the lateral pelvic tilt, wherein a determination stage includes:

the seated user standing;

the examiner placing a test-pad under an ischial tuberosity of a hip of the seated user on a side indicated to be lifted in the evaluation; and the seated user sitting on the test-pad, wherein at least substantial relief of discomfort upon sitting on the test-pad renders the determination step complete, and wherein no substantial relief of discomfort indicates a necessity for repeating the determination stage until discomfort is at least substantially relieved; and providing the orthopedic device based on the evaluation stage and the determination stage, the orthopedic device including:

a cushion including a left cushion-side and a right cushion-side relative to a seated user, the left cushion-side including a first thickness defining a first height, the right cushion-side including a second thickness defining a second height, the first height and the second height being different and defining a height differential between the left cushion-side and the cushion-right side, the height differential being customized to the seated user, the left side and the right side including the height differential based on the deviation height of the evaluated lateral pelvic tilt, and wherein the side indicated to be lifted in the evaluation stage includes a greater height.

2. The method of claim 1, wherein the evaluation stage includes the seated user sitting in front of the examiner with their back to the examiner and with their knees and hips flexed at 90 degrees.

3. The method of claim 2, wherein the cushion is configured to support only one of a left buttock and a right buttock of the seated user.

4. The method of claim 1, wherein the orthopedic device is made custom for the seated user.

5. The method of claim 4, wherein the left cushion-side includes a left pad configured to support the left buttock of the seated user, wherein the right cushion-side includes a right pad configured to support the right buttock of the seated user, wherein the left pad includes the first thickness defining the first height, and wherein the right pad includes the second thickness defining the second height.

6. The method of claim 5, wherein the left side and the right side of the seated user is relative to a posterior superior iliac spine of the seated user.

* * * * *